United States Patent [19]

Hoerkens

[11] Patent Number: 4,635,324

[45] Date of Patent: Jan. 13, 1987

[54] SLIDE FASTENER

[76] Inventor: Reiner Hoerkens, Bahnhofstrasse 31, D-6903 Neckargemünd, Fed. Rep. of Germany

[21] Appl. No.: 649,540

[22] Filed: Sep. 12, 1984

[30] Foreign Application Priority Data

Oct. 29, 1983 [DE] Fed. Rep. of Germany ..... 3339319
Mar. 3, 1984 [DE] Fed. Rep. of Germany ..... 3407897

[51] Int. Cl.[4] ..... A44B 19/06

[52] U.S. Cl. ..... 24/413; 24/415; 24/431

[58] Field of Search ..... 24/403–415, 24/431

[56] References Cited

U.S. PATENT DOCUMENTS

| | | | |
|---|---|---|---|
| 557,207 | 3/1896 | Judson | 24/413 X |
| 991,251 | 5/1911 | Thomas | 24/413 |
| 2,031,959 | 2/1936 | Kelly | 24/413 |
| 2,067,735 | 1/1937 | Silberman | 24/413 |
| 2,068,939 | 1/1937 | Winterhalter | 24/410 |
| 2,191,874 | 2/1940 | Winterhalter | 24/405 X |
| 2,397,331 | 3/1946 | Winterhalter | 24/413 |
| 2,495,033 | 1/1950 | Sullivan | 24/405 X |
| 4,418,445 | 12/1983 | Heimberger et al. | 24/413 X |

FOREIGN PATENT DOCUMENTS

| | | | |
|---|---|---|---|
| 277964 | 1/1952 | Switzerland | 24/406 |

*Primary Examiner*—Peter A. Aschenbrenner
*Attorney, Agent, or Firm*—Balogh, Osann, Kramer, Dvorak, Genova & Traub

[57] ABSTRACT

The invention relates to a slide fastener, which is particularly well suited for ornamental purposes. The slide fastener comprises teeth, which are arranged in two juxtaposed rows so that each teeth is adapted to interlock with adjacent teeth of the opposite row. The slide fastener is adapted to be opened and closed by a slider. The slide fastener should have a high flexibility in conjunction with a higher stability and should be adapted to carry ornamental stones or to be used as an ornamental fastener in itself. Besides, the slide fasteners, with the exception of the slider, should be adapted to be made as an endless strip on a machine. And the slide fastener should be adapted to be used as an ornamental braid without a textile carrying strap. Such ornamental braid should have a slider for opening and closing the braid and for adjusting its length. To accomplish said objects each tooth of the slide fastener has a preferably rounded rear portion that is enlarged in width and adjacent teeth of the same row are interconnected by laterally protruding lugs and/or pins so that they are movable relative to each other. In another embodiment each tooth has a preferably rounded rear portion which is enlarged in width and the rear portions of the teeth of each row are relatively movably connected by crosspins to a textile fabric consisting particularly of a strap.

2 Claims, 24 Drawing Figures

SLIDE FASTENER

BACKGROUND OF THE INVENTION

1. Technical Field

This invention relates to a slide fastener which is particularly adapted to be used for ornamental purposes and comprises teeth which are arranged in two juxtaposed rows and adapted to interdigitate and interlock when the fastener is closed, and a slider, which is movable along said rows so as to open and close the fastener.

2. Description of the Prior Art

Numerous known slide fasteners comprise a plurality of teeth, which are arranged in two juxtaposed rows and adapted to interdigitate and interlock when the fastener is closed, and a slider, which is movable along said rows so as to open and close the fastener. The teeth of each row are attached to a strap, to which they are sewn or secured by means of claws. The reliability of all said known slide fasteners when closed will depend on the strap. Besides, the use of the slide fastener will be restricted by the color of the strap. Most of the known slide fastener are covered because they are devices which have been attached to a textile fabric.

SUMMARY OF THE INVENTION

It is an object of the invention to provide a slide fastener which is highly flexible but is reliable in a closed condition and which can be used as an ornamental fastener if it is provided with ornamental stones and the like. Besides, the fastener should be adapted to be manufactured in a continuous operation as an endless strip, which can subsequently be divided in a simple manner into pieces of suitable length, which are then provided with end pieces and with a slider for opening and closing the fastner. It is also desired to provide a slide fastener which can be used without a strap as an ornamental braid, which can be opened and closed by means of a slider and can be adjusted in width.

In a slide fastener which comprises teeth, which are arranged in two juxtaposed rows and adapted to interdigitate and interlock when the fastener is closed, and a slider, which is movable along said rows so as to open and close the fastener, said object is accomplished in one embodiment of the invention in that each teeth has a preferably rounded rear portion that is enlarged in width and the rear portions of adjacent teeth of each row are interconnected by laterally protruding lugs and/or pins permitting a movement of said adjacent rear portions relative to each other, or in another embodiment in that the rear portions of the teeth are enlarged in width and are provided with pins and the pins of all teeth of a row are pivotally mounted in a textile fabric. In both cases the rear portions of adjacent teeth of a row contact each other so that the stability of the slide fastener is improved, particularly during the opening and closing operation. In one case adjacent teeth of each row are interconnected so that there is no need for anchoring the teeth in a textile fabric, such as a strap. In the other case the connection provided by the textile fabric is better than in the known slide fasteners.

In the embodiment in which adjacent teeth of a row are interconnected by means of laterally protruding lugs or pins permitting said adjacent teeth to move relative to each other, each tooth can be hooked into an adjacent tooth of the same row by means of holes, pins upstanding lugs or connecting heads. If adjacent teeth of a row are connected by means of laterally protruding pins, the latter may be connected to the respective adjacent teeth in that the pin has a head that extends into a socket formed in the adjacent tooth. Rear portions which may be enlarged in width may comprise a base and a cover in the form of plates or loops and said base and cover may be interconnected by crosspins.

If the teeth are relatively movably interconnected by a textile fabric, such as a strap, and are provided with crosspins which extend through the textile fabric and interconnect a cover plate and a base plate, the crosspins may be connected to said plates by being riveted or in that an end lug of the pin is anchored in one of the plates. The pins may extend from the base plate beyond the cover plate to form mounting claws for ornamental stones to be mounted on the cover plates.

Further details of slide fasteners in accordance with the invention will be described with reference to the drawings showing illustrative embodiments.

BRIEF DESCRIPTION OF THE DRAWINGS

FIGS. 12, 12*b*, 12*c* and 12*d* are transverse sectional views taken on line XII—XII in FIG. 12 and illustrating different embodiments of the slider.

Figure 1:
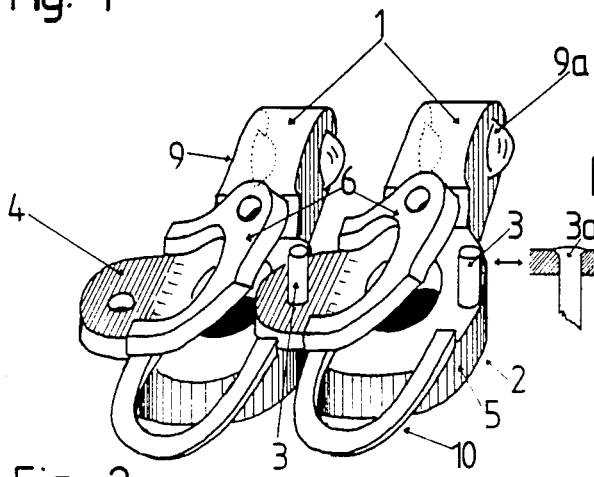
FIG. 1 is a perspective of the bottom or back view of the teeth of a slide fastener of the present invention.
Figure 2:
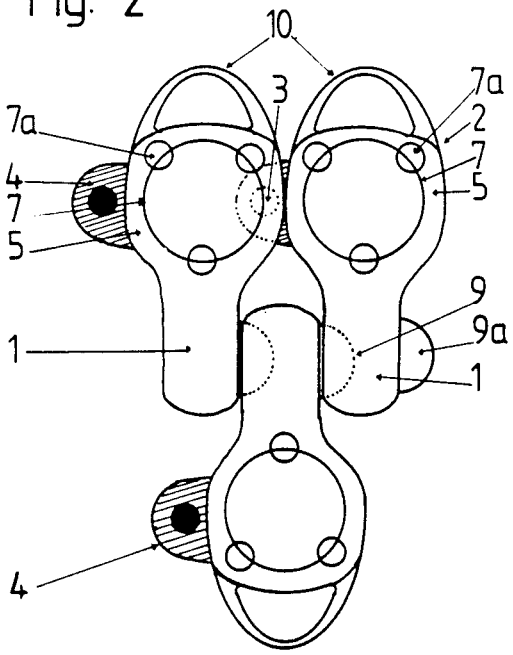
FIG. 2 is a top plan or front view of the slide fastener showing interconnection of opposing teeth.

The slide fastener of the first embodiment shown in FIGS. 1 and 2 comprises teeth 1 having rounded rear portions 2, which are enlarged in with. As is apparent from FIG. 2, adjacent teeth 1 of the same row contact each other so that they are movable relative to each other. The means connecting adjacent teeth of the same row so that they are movable relative to each other consist of upstanding pins 3 and lugs 4 receiving said pins. Alternatively, the means connecting the teeth may comprise laterally protruding pins rather than lugs. In the embodiment shown in FIGS. 1 and 2, the upstanding pins 3 are mounted on the inside surface of the cover plates 5 and the base plates consist of loops 6, which are closed when the lug 4 of an adjacent tooth has been hung onto the pin 3.

Figure 1A:
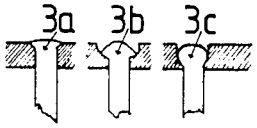
FIG. 1*a* is an enlarged partial cross-section view of three variations of attachment of pins shown in FIG. 1.

FIG. 1*a* illustrates various upstanding pins 3*a*, 3*b* and 3*c*, which may consist of metal and are, e.g., riveted or which consist of plastic and in that case are used to establish a snap joint.

Figure 2A:
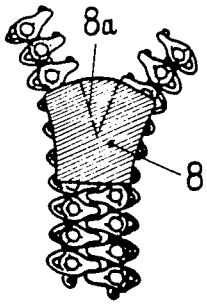
FIG. 2*a* is a top plan or front view of the teeth shown in FIG. 2, but oriented by 90°, which teeth are engaged by a slider.

In accordance with FIG. 2 the cover plate has a seat 7 provided with claws 7*a* embedded in the cover plate 5 for retaining an ornamental stone on the seat 7. FIG. 2*a* shows an associated slider 8 of the type used in conventional slide fasteners.

As in conventional slide fasteners, each tooth 1 is provided on opposite sides with a boss and a recess 9, which respectively interlock with a recess 9 and a boss 9*a* of adjacent teeth of the opposite row when the fastener is closed. The slide fastener is closed and opened in known manner by means of the slider 8 having a separating wedge 8*a*. The slide fastener may be provided with end pieces, not shown, which facilitate the threading of the slide fastener into the slider 8. The rearwardly protruding eyelets 10 are used to secure the slide fastener to the edge of the textile fabric and may be replaced by claws.

Figure 3:
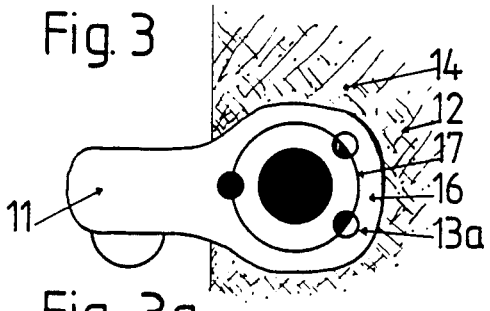
FIGS. 3, 3*a*, 3*b* and 3*c* are, respectively, a top plan view, two side elevations and a sectional view showing a second embodiment of slide fastener teeth.
Figure 3A:
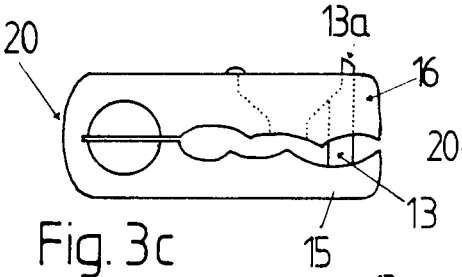
Figure 3B:
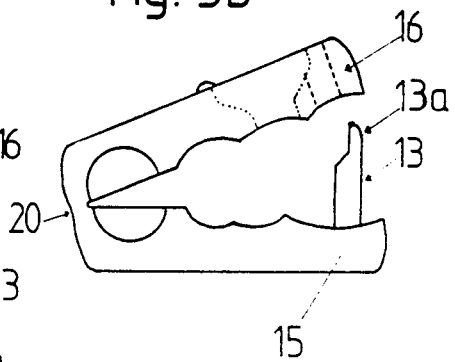
Figure 3C:
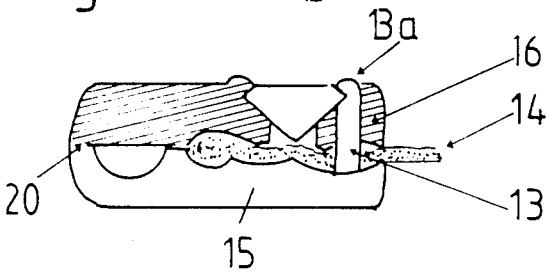
Figure 4:
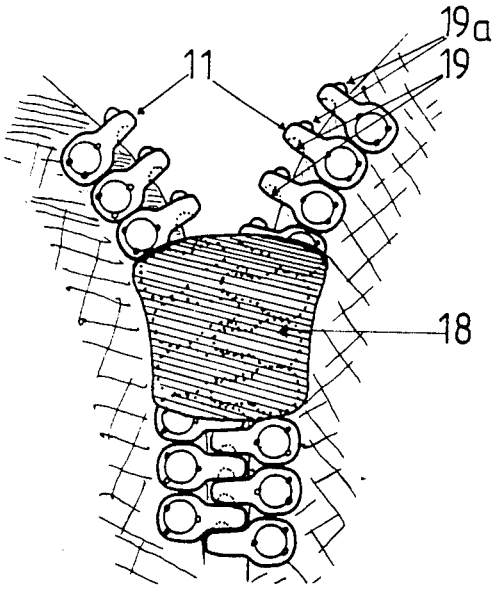
FIG. 4 is a top plan view showing two rows of the slide fastener teeth shown in FIGS. 3 to 3*c* and an associated slider.

In the second embodiment shown in FIGS. 3 and 4 the slide fastener consists also of teeth 11 which have round rear portions 12 that are enlarged in width. As is apparent from FIG. 4, the rear portions 12 of adjacent teeth of the same row contact each other so that they are movable relative to each other. In the present embodiment, adjacent teeth of the same row are provided with crosspins 13, which extend through and are relatively movably connected to a strap 14, which extends throughout the length of the row of teeth, or to another textile fabric. The crosspins 13 are mounted on the base plates 15 and extend through and are connected to the cover plates 16, e.g., by being riveted thereto. Each cover plate 16 is provided with a seat 17 for an ornamental stone, which is retained by claws 13*a* formed by the laterally bent end portions of the pins 13.

FIG. 4 shows a slider 18. Each tooth 11 is provided on opposite sides with a recess 19 and a boss 19*a*, which respectively interlock with a boss 19*a* and a recess 19 of adjacent teeth of the opposite row when the fastener is closed. Each tooth 11 has a rear portion 12, which is enlarged in width and comprises a base plate 15 and a cover plate 16, which are connected by a web 20. To anchor the tooth 11 to the strap 14, the base plate 15 and the cover plate 16 are forced toward each other so that the crosspin 13 penetrates the strap 14.

Figure 5:
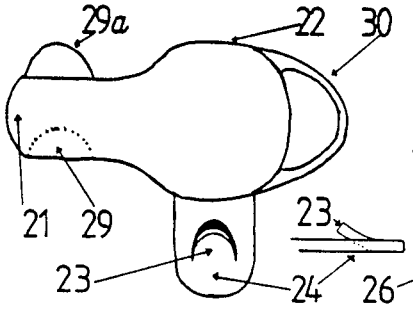
FIGS. 5, 5*a* and 5*b* are respectively, a top plan view showing a third embodiment of the slide fastener teeth and two sectional views illustrating two different connecting means.
Figure 5A:
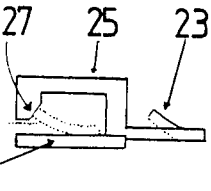
Figure 5B:
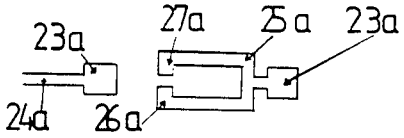
Figure 6:
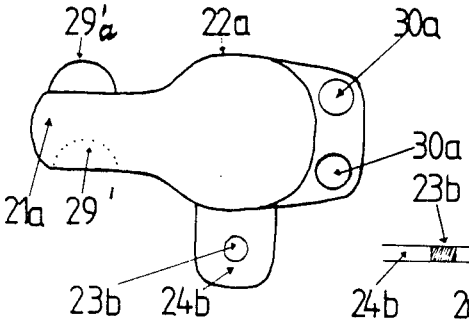
FIGS. 6 and 6*a* are, respectively, a top plan view showing a fourth embodiment of slide fastener teeth and a sectional view showing connecting means.
Figure 6A:
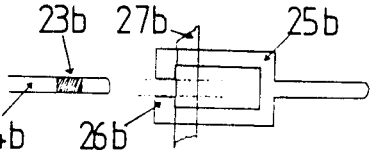

The teeth 21 and 21*a* shown in FIGS. 5 and 6 comprise rounded rear portions 22*a* and 22*b*, respectively, which are enlarged in width and provided with upstanding lugs 23, connecting heads 23*a* or holes 23*b*. Lugs 24, 24*a* or 24*b* of said rear portions are inserted between the cover plates 25, 25*a* or 25*b* and base plates 26, 26*a* or 26*b* of adjacent teeth of the same row so that such teeth are relatively movably interconnected. The cover and base plates are provided with stops 27, 27*a* or pins 27 for locking the detachable joints between adjacent teeth of the same row.

Figure 7:
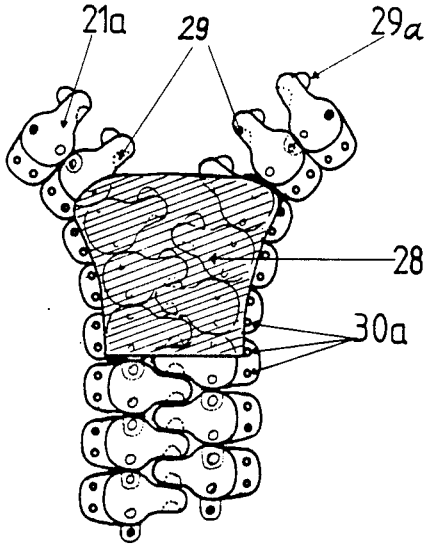
FIG. 7 is a top plan view showing two rows of teeth and an associated slider.

FIG. 7 shows a slider 28 for opening and closing the slide fastener. Each of the teeth 21 or 21*a* of the slide fastener is provided on opposite sides with a recess 29 or 29' and with a boss 29*a* or 29*a'* which respectively interlock with a boss and a recess of adjacent teeth of the opposite row. The rearwardly protruding eyelets 30 or 30*a* serve to secure the slide fastener to the edge of the textile fabric.

Instead of carrying an ornamental stone, the enlarged cover plates of the teeth may constitute ornamental elements themselves. The slider comprising a base plate and a cover plate may be provided with a transparent cover and its central portion may be designed as a seat for an ornamental stone. It is apparent that the slide fasteners may be designed in various ways as ornamental elements.

Figure 8:
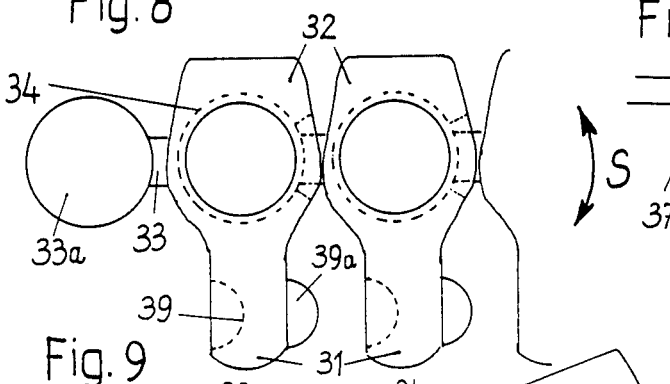
FIGS. 8 and 9, respectively, a top plan view and a side elevation showing a further embodiment of slide fastener teeth.
Figure 10:
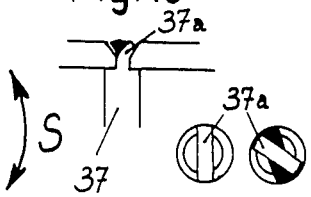
FIG. 10 illustrates a connection made by means of a pin rather than a rivet.
Figure 9:
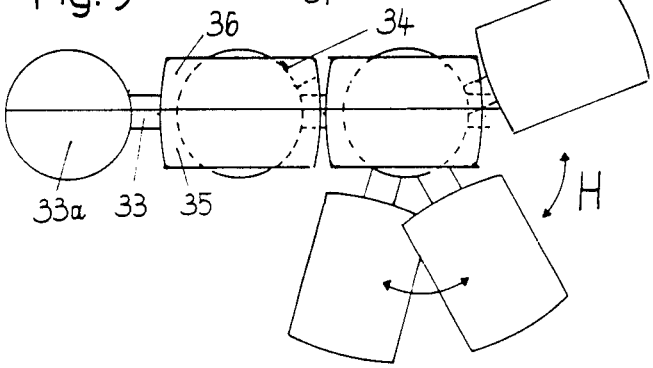
Figure 11:
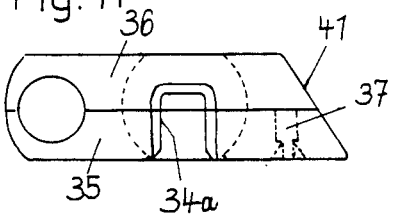
FIGS. 11 and 12 are, respectively, a side elevation showing a slide fastener tooth and a top plan view showing the associated slider.

The teeth 31 shown in FIGS. 8 and 9 have rounded rear portions 32, which are enlarged in width and flattened at the rear. Each tooth 31 is provided with a laterally protruding pin 33, which has a ball head 33*a* fitting a ball socket 34 of an adjacent tooth of the same row so that adjacent teeth of the same row are movable relative to each other not only in their own plane in the direction indicated by the arrows but also transversely to said plane in the direction indicated by an arrow H because side slots and bottom slots 34*a* shown in FIG. 11 are provided. Each tooth consists of a base plate 35 and a cover plate 36, which are connected by a crosspin 37. In accordance with FIG. 10 each tooth can be held in a closed position in that the crosspin 37 is rotated to move the end lug 37*a* of the crosspin 37 to a locking position when the ball head 33*a* has been fitted into the ball socket 33. Just as each tooth, each ball head 33*a* consists of two halves, as is apparent from FIG. 9.

Each tooth 31 is provided on opposite sides with a recess 39 and a boss 39*a*, respectively. A slider 38 is provided for opening and closing the slide fastener. This embodiment is particularly suitable as a necklace.

Figure 12:
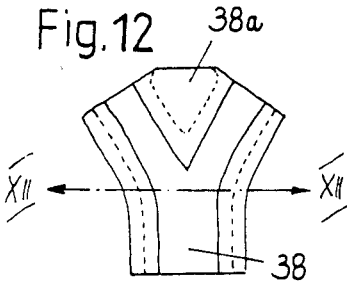
Figure 12A:
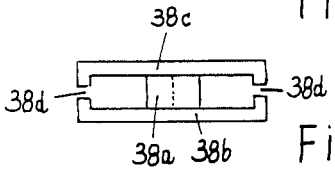
Figure 12B:
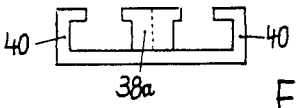
Figure 12C:
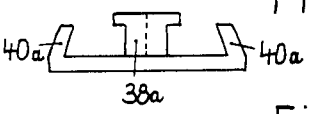
Figure 12D:
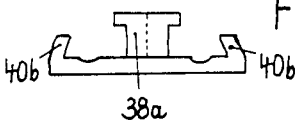

In accordance with FIG. 12*a*, the slider 38 shown in FIG. 12 has a separating wedge 38*a* between a base 38*b* and a cover 38*c*. In this case, the side slots 38*d*, through which the strap of the slide fastener extends in other embodiments, may be omitted and may be replaced by a slider portion 40 for embracing the teeth, as shown in FIG. 11*b*. Sliders for slide fasteners having teeth formed with beveled side faces 41 (FIG. 11) may be provided with acute-angled portions 40*a*, as shown in FIG. 12*a*, for embracing the teeth, or with shorter acute-angled portions 40*b*, shown in FIG. 12*d*, for the same purpose.

I claim:

1. In an ornamental slide fastener comprising:

a multiplicity of teeth arranged in two juxtaposed rows, each of said teeth having a front portion directed toward the other row and arranged to extend between and to interengage with the front portions of two adjacent teeth of the other row in a closed position of the fastener;

a slider, which is movable along said rows so as to accommodate and engage part of said teeth of each of said rows at a time and to open and close said fastener; and interconnecting means connecting adjacent teeth of each of said rows to each other and resisting a separation of adjacent teeth of the same row along said rows while permitting adjacent rows of the same row to move relative to each other when said front portion of said teeth of each row are disengaged from the front portions of adjacent teeth of the other row;

the improvement residing in that each of said teeth has a rear portion, which is wider than said front portion in the longitudinal direction of the corresponding row and is formed on mutually opposite sides with convexly curved side faces facing convexly curved side faces of said rear portions of adjacent teeth of the same row;

said interconnecting means consist of a plurality of projections, which are rigid with and laterally protrude from the rear portions of respective ones of said teeth of each of said rows, and of cooperating means, which are rigid with the rear portions of respective ones of said teeth of each of said rows and pivotally interengage with said projections to resist a separation of said rear portions of adjacent teeth of the same row along said row, said interconnecting means including protruding members for securing said teeth to a support structure; and said projections and cooperating means are the only means which are connected to said teeth of each of said rows and resist a separation of said rear portions of adjacent teeth of the same row along said row when said front portions of said teeth of each row are disengaged from the front portions of adjacent teeth of the other row;

each of said cooperating means comprises an apertured lug formed in said rear portion of one of said teeth; and each of said projections comprises a laterally protruding pin having an enlarged head which is captively and pivotally held in one of said apertured lugs.

2. The improvement set forth in claim 1, wherein each of said rear portions is forked and comprises two legs joined by a bight which has an aperture for receiving said pin for defining said socket and retaining means resisting a separation of the adjoining rear portions.

* * * * *